US012012673B2

(12) United States Patent
Wang

(10) Patent No.: US 12,012,673 B2
(45) Date of Patent: Jun. 18, 2024

(54) WEBBING AND RELATED METHODS

(71) Applicant: HAMPTON PRODUCTS INTERNATIONAL CORPORATION, Foothill Ranch, CA (US)

(72) Inventor: Hui Wang, Taizhou (CN)

(73) Assignee: HAMPTON PRODUCTS INTERNATIONAL CORPORATION, Foothill Ranch, CA (US)

( * ) Notice: Subject to any disclaimer, the term of this patent is extended or adjusted under 35 U.S.C. 154(b) by 520 days.

(21) Appl. No.: 17/224,922

(22) Filed: Apr. 7, 2021

(65) Prior Publication Data

US 2021/0317602 A1 Oct. 14, 2021

Related U.S. Application Data

(60) Provisional application No. 63/007,059, filed on Apr. 8, 2020.

(51) Int. Cl.

| | |
|---|---|
| ***D03D 13/00*** | (2006.01) |
| ***D03D 1/00*** | (2006.01) |
| ***D03D 15/283*** | (2021.01) |
| ***D03D 15/292*** | (2021.01) |
| ***D03D 15/43*** | (2021.01) |

(52) U.S. Cl.

CPC ..... *D03D 13/004* (2013.01); *D03D 1/00* (2013.01); *D03D 15/283* (2021.01); *D03D 15/292* (2021.01); *D03D 15/43* (2021.01)

(58) Field of Classification Search

CPC ..... D03D 13/004; D03D 1/00; D03D 15/283; D03D 15/292; D03D 15/43; Y10T 428/24777; Y10T 428/24785

See application file for complete search history.

(56) References Cited

U.S. PATENT DOCUMENTS 780,726 A * 1/1905 Palmer ..... D03D 19/00 256/45
4,362,199 A * 12/1982 Futerman ..... B65D 88/1681 383/17
4,856,837 A * 8/1989 Hammersla, Jr. ..... B66C 1/18 139/411

OTHER PUBLICATIONS

[NPL-1] "Textile Glossary"; Celanese Acetate LLC (2001); pp. 183. (Year: 2001).*

Global Industrial; https://www.globalindustrial.com/p/material-handling/hoists-cranes/lifting-slings-straps/sling-eye-and-eye-6-ft-1-x-1-in-w; Printed Apr. 7, 2021 (2 pages).

* cited by examiner

*Primary Examiner* — David Sample
*Assistant Examiner* — Donald M Flores, Jr.

(57) ABSTRACT

A webbing and methods for manufacturing the same are disclosed herein. The webbing may include a first set of threads having a first plurality of nylon fibers. The first set of threads may be woven together across a first webbing end and a second webbing end. The webbing may include a second set of threads having a second plurality of nylon fibers. The second set of threads may have a hard polymer coating. The second set of threads may be woven together across the first webbing end and the second webbing end along a first edge of the webbing and a second edge of the webbing. The hard polymer coating may be reflective.

21 Claims, 5 Drawing Sheets

WEBBING AND RELATED METHODS

RELATED APPLICATION

This application claims priority to U.S. Provisional Application No. 63/007,059, which was filed Apr. 8, 2020. The entirety of the priority application is hereby incorporated by reference.

FIELD OF ART

The present disclosure relates generally to fastening devices. More particularly, the present disclosure relates to a webbing having reinforced edges.

BACKGROUND

Tie-down hardware featuring cam buckles or ratchet mechanisms are commonly used with webbing to strap down and secure cargo or objects in place. Tow straps or recovery straps also feature webbings to provide a durable connection between a first vehicle being towed or recovered and a second vehicle or object being used to pull or provide leverage for the first vehicle. Since webbings are used in carrying heavy loads and in rough environments, such as industrial settings, they are prone to wear-and-tear damage, particularly cutting and fraying propagating from edges of the webbings. Webbings often secure valuable cargo or tow motor vehicles, which are not only valuable but also come with the risk of causing damage to other valuables, injury, or even death in case of an accident or malfunctioning of the webbings.

SUMMARY

The present specification describes improved webbings and methods of making same that have improved durability and operability.

In accordance with a first embodiment the present specification provides a webbing comprising a plurality of first threads, each first thread comprising a first plurality of fibers, said first threads woven together along a length of the webbing to form a main webbing portion having a width and a first thickness. A plurality of second threads is also provided. Each of the second threads comprises a second plurality of fibers encased in a hard polymer coating, the plurality of second threads woven together along the length of the webbing and attached to the main webbing portion so as to form a protective portion having a second thickness. The second thickness is greater than the first thickness.

In additional embodiments the protective portion is disposed along an edge of the main webbing portion.

In yet additional embodiments, each of the first threads comprises a first count of fibers and each of the second threads comprises a second count of fibers, the first count being greater than the second count; and wherein the hard polymer coating does not penetrate between the second plurality of fibers.

In further embodiments the protective portion is disposed within the main webbing portion and spaced from opposing side edges of the main webbing portion.

Still further embodiments additionally comprise a weft thread interwoven with the first threads so as to extend laterally relative to the first threads over a plurality of weft rows, the weft thread changing direction between weft rows. The weft thread is interwoven with the second threads between weft rows. In some such embodiments an outermost portion of the weft thread is spaced a first distance from a longitudinal axis of the webbing and an outermost portion of the second threads is spaced a second distance from the longitudinal axis of the webbing, and the second distance is greater than the first distance. In additional such embodiments, the second threads are interwoven with one another in addition to the weft threads.

In accordance with another embodiment the present specification describes webbing comprising a first set of first threads. Each first thread comprises a first plurality of nylon fibers, said first set of first threads woven together from a first webbing end to a second webbing end. A second set of second threads is also described. Each second thread comprises a second plurality of nylon fibers, said second threads each having a hard polymer coating. Said second set of second threads is woven together from the first webbing end to the second webbing end along a first edge of the webbing and a second edge of the webbing. The hard polymer coating is reflective and does not penetrate between the second plurality of nylon fibers.

In further embodiments the hard polymer coating has a Rockwell hardness between and including R95 and R125.

In yet further embodiments the hard polymer coating is Polybutylene Terephthalate ("PBT").

In still further embodiments the first plurality of nylon fibers comprise a first count of nylon fibers and the second plurality of nylon fibers comprise a second count of nylon fibers, the first count being greater than the second count.

In yet additional embodiments, for each second thread the second plurality of nylon fibers is arranged with a circular cross-section having a diameter of about 0.20-0.030 in., and the diameter is about 4-7 times a thickness of the hard polymer coating.

In still additional embodiments the first set of threads and the hard polymer coating are the same color.

In yet further embodiments the first webbing end forms a first loop and the second webbing end forms a second loop. Some such embodiments further comprise end hardware attachable to each of the first and second loops.

In still further embodiments the interwove first set of threads have a first thickness between outermost ones of the first threads, and the interwoven second set of threads along the first edge have a second thickness between outermost ones of the second threads, the first thickness being lesser than the second thickness.

In accordance with yet another embodiment the present specification provides a method of manufacturing a webbing. The method comprises providing a first set and a second set of spools of thread, said first set of threads comprising a first plurality of nylon fibers and said second set of threads comprising a second plurality of nylon fibers. A reflective and hard polymer is also provided. The hard polymer is melted by applying heat at or above melting temperature. The threads of the second set of spools of thread are coated with the melted hard polymer. The melted hard polymer is allowed to harden around the threads of the second set of spools of thread without penetrating between the second plurality of nylon fibers. The first and second sets of spools of thread are woven into a webbing, the second set of spools of thread lining a first and second longitudinal edge of the webbing. The webbing is cut to a first end and a second end having a length therebetween.

Additional embodiments further comprise sewing the first end onto the webbing to form a first loop and sewing the second end onto the webbing to form a second loop. Some such embodiments further comprise attaching end hardware around at least one of the first and second loops.

In additional embodiments the hard polymer coating has a Rockwell hardness between and including R95 and R125. In some such embodiments the hard polymer coating is Polybutylene Terephthalate ("PBT").

In yet additional embodiments the first plurality of nylon fibers comprise a first count of nylon fibers and second plurality of nylon fibers comprise a second count of nylon fibers, the first count being greater than the second count.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
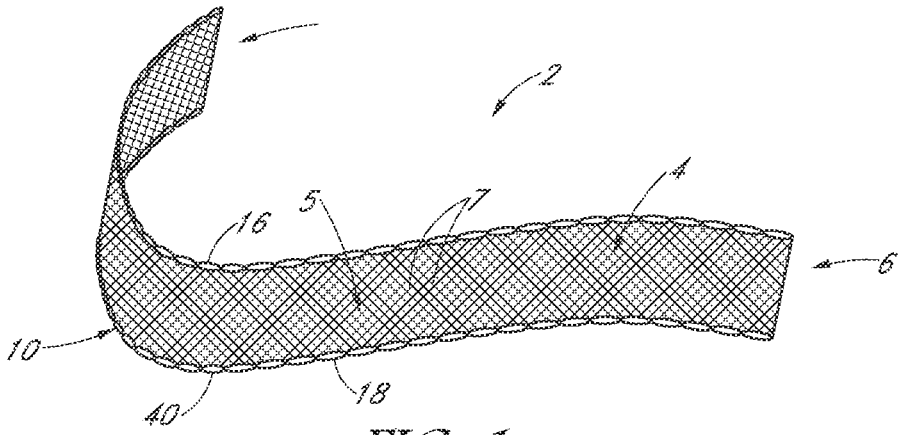
FIG. 1 is a perspective view of a webbing in accordance with one embodiment.

With initial reference to FIGS. 1-6, an embodiment of a webbing 2 is shown. The illustrated webbing 2 is elongated, extending from a first webbing end 6 to a second webbing end 8, and having a width 24 defined between opposing first and second edges 16, 18. In the illustrated embodiment, a main webbing portion 4 comprises a first set 5 of first threads 7 that are woven together from the first webbing end 6 to the second webbing end 8 and from the first edge 16 to the second edge 18. Preferably, each thread 7 of the main webbing portion 4 comprises a plurality of second fibers that are spun, bunched, woven, or otherwise gathered together to form a thread 7.

A second set 10 of second threads 40 is attached to the main webbing portion 4 along each of the first and second edges 16, 18. Each thread 40 of the second set 10 of threads comprises a second plurality of second fibers 12 that are spun, bunched, woven or otherwise gathered together. In the illustrated embodiment, each thread 40 of the second set of threads 10 comprises a hard polymer coating 14 disposed over the fibers 12 so as to encase the gathered fibers about the circumference of the thread 40. The hard polymer coating 14 may be reflective. The second threads 40 of each second 10 set of threads preferably are woven together and to the main webbing portion 4 at and adjacent the first edge 16 and second edge 18 along the length of the webbing 2. As such, the second sets 10 of threads 40 are spaced from a longitudinal center 11 of the webbing 2.

With specific reference to FIG. 1, a length of the webbing 2 is shown. In some embodiments, the threads 7, 40 of the first and second sets of threads 5, 10 are both made of substantially identical nylon fibers. In some embodiments, the first and second fibers of the respective first and second threads 7, 40 may be another natural or synthetic fiber. By example and not limitation, another synthetic fiber may be polyester, polypropylene, or Kevlar. In additional embodiments, the first fibers of the first threads 7 may be a different type of fiber than the second fibers 12 of the second threads 40, such as being made of different materials, having a different diameter and/or being different in color or other properties.

Figure 2:
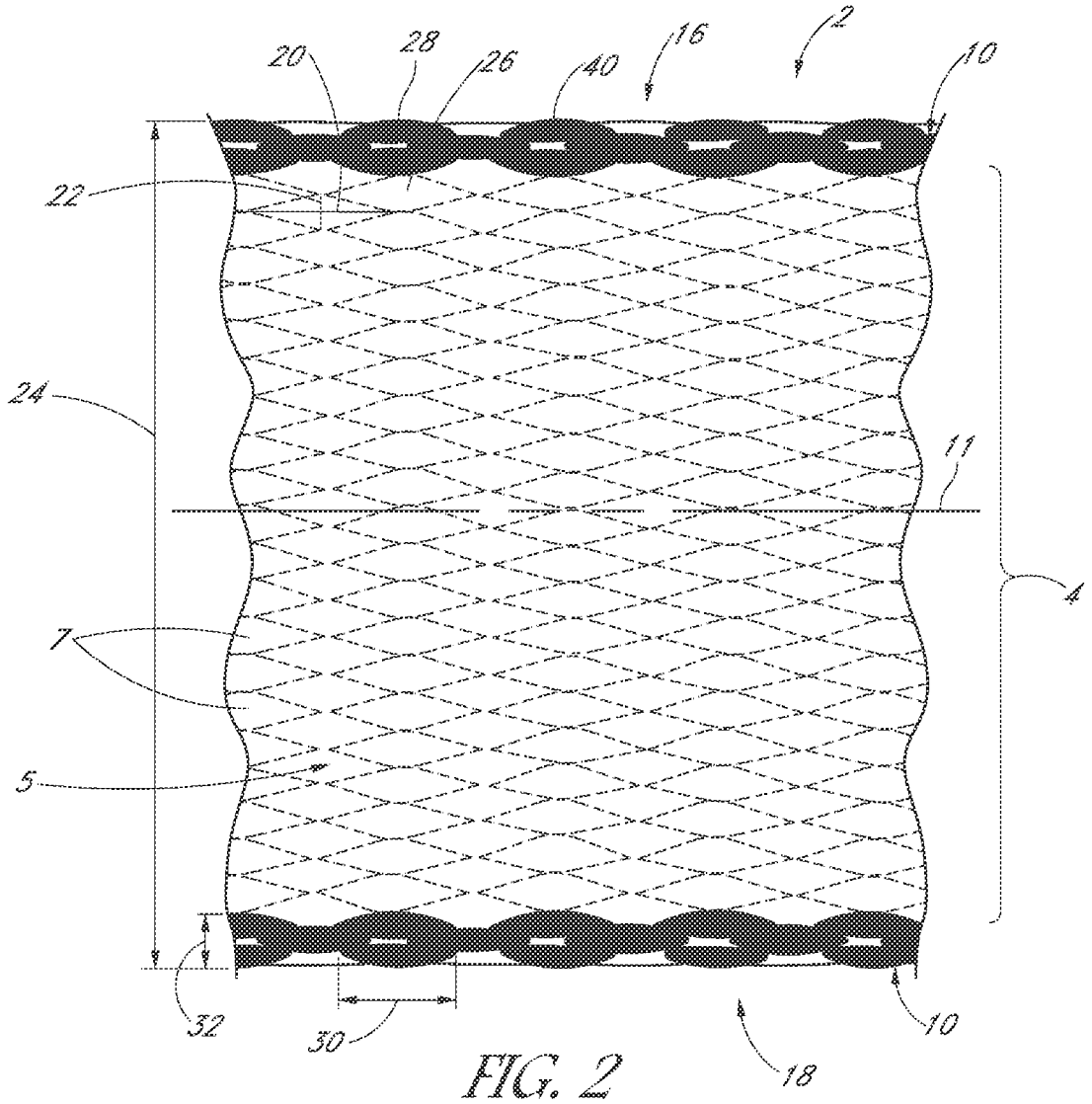
FIG. 2 is a top view of a section of the webbing of FIG. 1.
Figure 3:
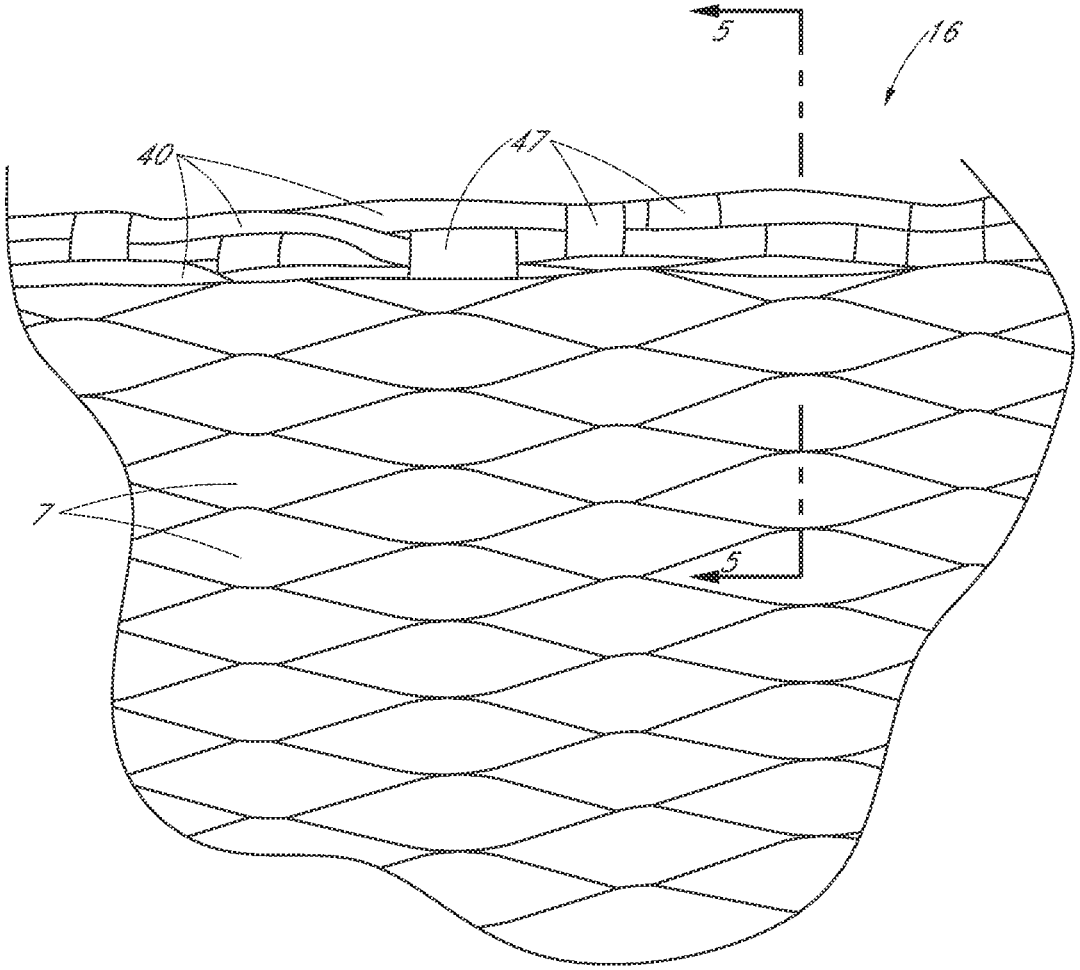
FIG. 3 is a close-up tope view of a portion of another embodiment of a webbing.
Figure 4:
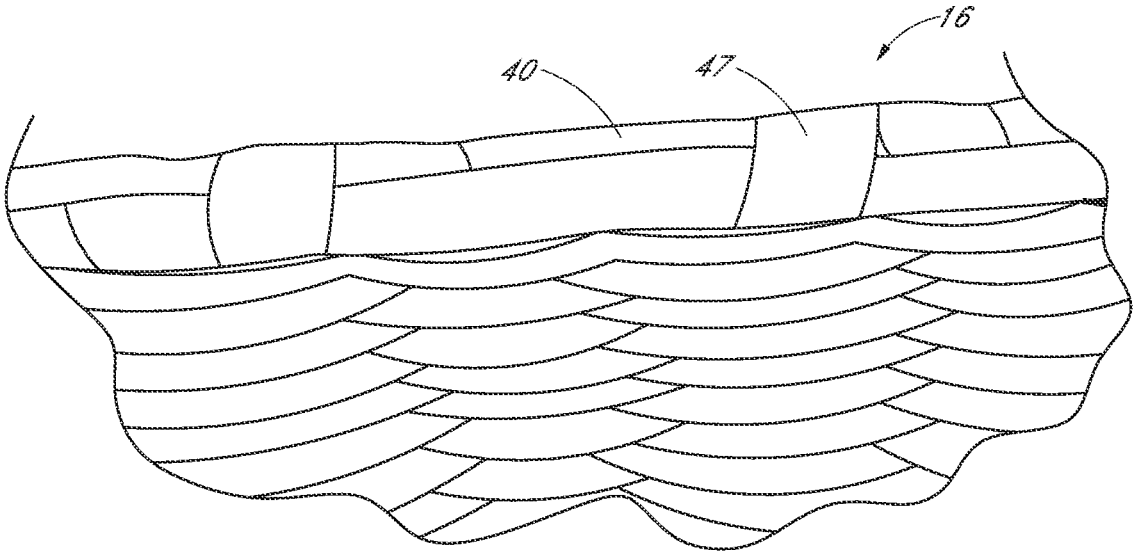
FIG. 4 is a close-up perspective edge view of the arrangement of FIG. 3.

With additional reference to FIG. 2-3A, in the illustrated embodiment the first set 5 of threads 7 is woven so that the longitudinally-extending warp threads of the main webbing portion 4 have a diamond-shaped appearance when overlapping a laterally-directed row of the weft 47. In the illustrated embodiment the weft generally is not visible in the main webbing portion 4. Preferably, however, the weft 47 is configured to form a self-finished edge (selvedge) along the first and second edges 16, 18. It is to be understood that, in additional embodiments, different weaving patterns can be employed.

Continuing with reference to FIG. 2, diamond 26 of the diamond pattern in the illustrated main webbing portion may have a diamond length 20 in the direction of the longitudinal axis of the webbing 2 and a diamond width 22 in the direction of a width 24 of the webbing 2. As shown, the length 20 is greater than the width 24. The length 20 preferably is about 2-4 times the width 24. More preferably the length 20 is about three times the width 24.

Figure 6:
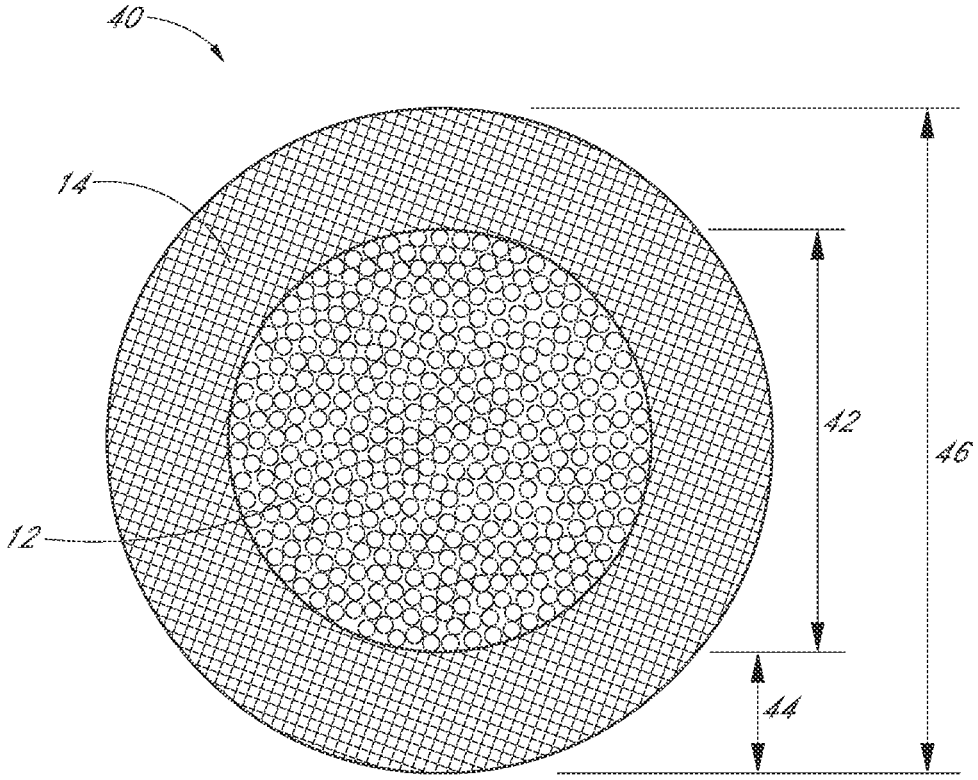
FIG. 6 is a cross-section of a thread according to an embodiment.

With specific reference to FIG. 6, a cross-section view of a thread 40 of the second set 10 of threads 40 of the webbing 2 is shown. The hard polymer coating 14 may coat an entirety of the exterior of the second thread 40 about the circumference of the thread 40. Preferably the fibers 12 of the thread 40 are gathered tightly. As such, the hard polymer coating 14 may not penetrate far between or impregnate the fibers 12 of the thread 40. Accordingly, most of the fibers 12 are not directly restrained by the hard polymer. The gathered fibers 12 may have a diameter 42 preferably between about 1-10 times a thickness 44 of the hard coating 14, and more preferably about 4-7 times the thickness 44. The hard polymer coating 14 may have a thickness 44 preferably between about 0.002-0.010 in., more preferably between about 0.003-0.005 in., and about 0.004 in. in a preferred embodiment. The diameter 42 of the gathered fibers 12 preferably is about 0.015-0.040 in., more preferably is between about 0.020-0.030 in., and about 0.025 in. in a preferred embodiment. The thickness 44 of the hard polymer coating 14 preferably is substantially consistent about the circumference of the gathered fibers 12 and along their lengths. Hence, the thread 40 with the hard polymer coating 14 preferably retains a generally circular cross-section.

In a preferred embodiment, the hard polymer coating 14 comprises Polybutylene Terephthalate ("PBT"). In some embodiments, the hard polymer coating 14 may be another polymer having a Rockwell hardness in a solid state between and including, preferably, R80 and R140, and most preferably, R95 and R125. By example and not limitation, the hard polymer coating 14 may also comprise polyethylene terephthalate ("PET"). The hard polymer coating 14 (such as PBT) may have reflective properties. The reflective properties may allow for the hard polymer coating 14 lining the first and second edges 16, 18 of the webbing 2 to reflect light and be seen in the dark.

The coated threads 40 may be manufactured by first melting the polymer of the hard polymer coating 14 by applying heat to the polymer at or above its melting temperature. Once melted, the polymer may be a viscous fluid. The second threads 40 may be unwound from a spool (not shown) and dipped in the melted polymer to be coated. Once the polymer hardens around the second threads 40, the polymer may achieve the previously mentioned desired hardness properties. For hardening, the polymer may be left to dry under ambient air or cooled. Preferably, the hard polymer coating 14 does not impregnate or penetrate substantially between the fibers 12 of the second threads 40.

In some embodiments, the number of second fibers 12 in each thread 40 of the second set 10 of threads is less than the number of first fibers in each thread of the first set 5 of threads 7. In other embodiments, the number of second fibers 12 may be equal to the number of first fibers. In further embodiments, the number of second fibers 12 may be greater than the number of first fibers. Additionally, in the illustrated embodiment, each thread 40 of the second set 10 of threads has an outer diameter less than that of each thread 7 of the first set 5 of threads (taken when the thread 7 is in a circular-cross-section configuration). However, in additional embodiments the threads may have substantially the same outer diameter. Notably, however, since the threads 7 of the first set of threads are not coated with any hard plastic layer, the cross-section of the threads may readily deform during weaving. For example, as depicted schematically in FIG. 5, it can be expected that the threads 7 of the warp will flatten out when taken over a layer of weft 47, but deflect to a circular or other cross-sectional shape between wefts when transitioning from a top to a bottom side of the weave—which helps create the diamond-shaped pattern discussed above. Since the threads 40 in the second set of threads 10 are coated with the hard plastic coating 14, the threads 40 are more likely to keep their generally-circular cross-sectional shape along their lengths.

The coated threads 40 of the second set 10 of threads may be woven into the main webbing 4 at the first and second edges 16, 18. In the embodiment illustrated in FIGS. 3-5, the second sets 10 of threads 40 at the first and second edges 16, 18 are woven in a pattern different than that of the first set 5 of threads 7 in the main webbing portion 4. For example, in the illustrated embodiment, each second set 10 comprises six threads 40, at least two of which are directly adjacent the outermost (relative to the longitudinal axis) of the first threads 7 and follow a similar pattern. The remaining four second threads 40, however, are disposed further outwardly from the longitudinal axis and are held in place by being interwoven with each other and with the weft 47, which wraps about them as the weft 47 changes direction between rows along the length of the webbing 2. As such, not only are the second threads 40 incorporated into the self-finished edge (selvedge), but the hard-coated second threads 40 are disposed outwardly from the longitudinal axis 11 of the webbing 2 relative to the first set 10 of threads, and thus impacts to and/or frictional scraping of the webbing 2 at the webbing edges 16, 18 will be directed to the coated second set 10 of threads rather than the uncoated first threads 7 in the main webbing portion 2. The hardness properties of the polymer coating 14 may thus mitigate cutting, fraying, and marring of the webbing 2 from the edges 16, 18.

In the embodiment shown in FIG. 2, the woven second set 10 of threads 40 of the webbing 2 may have a chain link pattern. Each link 28 of the chain link pattern may have a length 30 in the direction of the length of the webbing 2 and a width 32 in the direction of the width 24 of the webbing 2.

Figure 5:
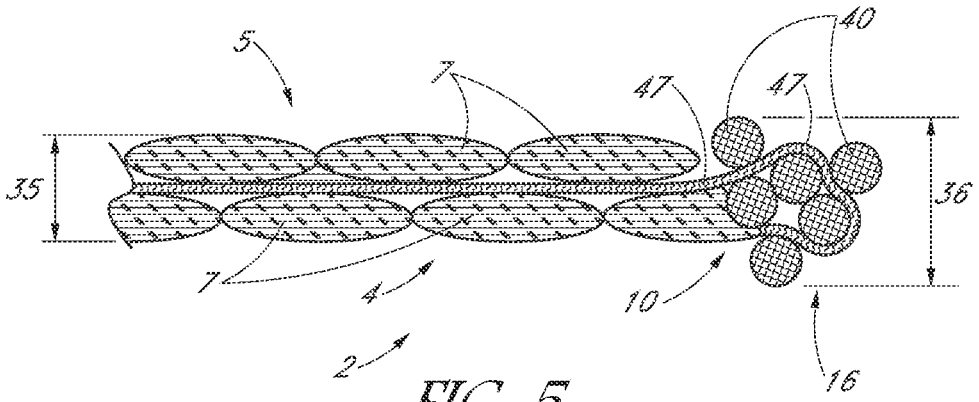
FIG. 5 is a cross-section taken along line 5-5 of FIG. 3.

In the embodiment illustrated in FIG. 5, the woven first set 5 of threads 7 in the main webbing portion 2 are configured so that the main webbing portion 4 has a first thickness 35. The second set 10 of threads 40 at and adjacent the edges 16, 18 preferably have a second thickness 36. In the illustrated embodiment the second thickness 36 is greater than the first thickness 35. As such, even when lying flat of a surface, and/or dragged over that surface, frictional forces tending to scrape and grind threads are preferentially directed to the coated threads 40 rather than the uncoated threads 7, providing some measure of protection to the first set 5 of threads 7. Additionally, as the second sets 10 of threads 40 are disposed outwardly from the longitudinal center 11 than are the first set 5 of threads 7, impacts and other contacts with the side edges 16, 18 tend to be directed to the coated second threads 40 rather than the uncoated first threads 7.

In a preferred embodiment the first thickness 35 of the main webbing portion 2 is between about 0.040-0.070 in., more preferably about 0.050-0.060 in., and most preferably about 0.055-0.056 in., while the second thickness 36 adjacent the edges 16, 18 is about 0.045-0.075 in., more preferably about 0.056-0.066 in., and most preferably is about 0.062 in.

In yet additional embodiments, a plurality of coated second threads 40 can also be disposed within the webbing main portion 4, such as at or adjacent the longitudinal axis 11. Preferably, these second threads 40 are configured so that the thickness at this location is greater than elsewhere within the webbing main portion—that is to say the coated second threads 40 extend upwardly and downwardly from the main portion further than do the uncoated first threads, providing further protection to the uncoated first threads.

Of course, in some embodiments, the thickness 36 may be equal to or smaller than the thickness 35 of the woven first set 5 of threads 7. But preferably at least some of the coated second threads 40 are disposed outwardly from the longitudinal center 11 from the webbing main portion 4 further than the first threads 7 so that the second threads 40 can provide some protection for the first threads 7.

Figure 7:
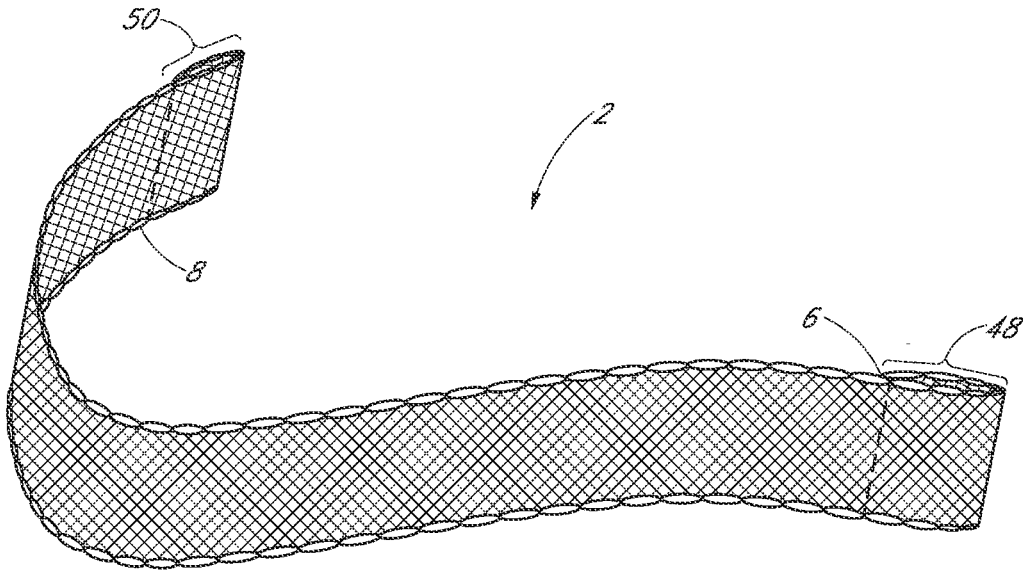
FIG. 7 is a perspective view of another embodiment of a webbing.

Referring now to FIG. 7, another embodiment of the webbing 2 is shown. Loops 48, 50 may be formed by folding the ends 6, 8 of the webbing 2 over the webbing 2 and fastening the ends 6, 8 onto the webbing 2. The ends 6, 8 may be fastened onto the webbing 2 on the same surface or alternate surfaces. By example and not limitation, fastening methods may include stitching, or adhesives. In some embodiments, only one of the ends 6, 8 may be looped. In some embodiments, the loops 18, 20 may be the same size. In some embodiments, the loops 48, 50 may be different sizes. In some embodiments, various end hardware (not shown) may be attachable to the first loop 48 and the second loop 50. By example and not limitation, the end hardware may include hooks, rings, buckles, or tension devices such as ratchet tie-downs and cam-buckle tie-downs. In some embodiments, the first and second loops 48, 50 may go over and around objects, for example poles or tree branches. In some embodiments, the first and second loops 48, 50 may be used for objects to hook onto, for example hooks, shackles, and chains.

The first webbing end 6 may form a first loop 48, and the second webbing end 8 may form a second loop 50. Various end hardware (not shown) may be attachable to the first loop 48 and the second loop 50. The first and second loops 48, 50 may go over objects or be used for objects to hook onto.

In a preferred embodiment, the first set 5 of threads 7 and the second set 10 of threads 40 are both the same color. However, the hard plastic coating 14 of the second threads 40 has reflective properties. Thus, even though the webbing 2 is all the same color it is reflective along its edges 16, 18.

In some embodiments, the first set 5 of threads 7 may have a solid color. In some embodiments, the first plurality of first fibers may be different colors so that each, some, or all of the threads of the first set 5 of threads 7 have multiple colors. In some embodiments, the first set 5 of threads 7 and the second set 10 of threads 40 may have the same color. In some embodiments, the first set 5 of threads 7 and the second set 10 of threads 40 may have different colors. In some embodiments, the first set 5 of threads 7 and the hard polymer coating 14 may be the same color. In some embodiments, the first set 5 of threads 7 and the hard polymer coating 14 may have different colors. In some embodiments, the hard polymer coating 14 on each, some, or all of the threads of the second set 10 of threads 40 may be a different color.

The webbing 2 may be cut widthwise to a desired length using an industrial cutting tool. First and second ends 6, 8 of the webbing 2 may be sealed. Sealing methods include but are not limited to holding the first and second ends 6, 8 near open flame, applying hot glue on the first and second ends 6, 8, and inserting end caps (not shown) over the first and second ends 6, 8.

The above description is given by way of example and not limitation. Given the above disclosure, one skilled in the art could devise variations that are within the scope and spirit of the disclosure. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A webbing comprising:

a plurality of first threads, each first thread comprising a first plurality of fibers, said first threads woven together along a length of the webbing to form a main webbing portion having an upper surface, a lower surface opposite the upper surface, a width and a first thickness; and a plurality of second threads, each of the second threads comprising a second plurality of fibers encased in a hard polymer coating, the plurality of second threads woven together along the length of the webbing and attached to the main webbing portion so as to form a protective portion having a second thickness;

wherein the second thickness is greater than the first thickness; and wherein the plurality of second threads extend upwardly from the upper surface of the main webbing portion and downwardly below the lower surface of the main webbing portion.

2. The webbing of claim 1, wherein the protective portion is disposed along an edge of the main webbing portion.

3. The webbing of claim 2, additionally comprising a weft thread interwoven with the first threads so as to extend laterally relative to the first threads over a plurality of weft rows, the weft thread changing direction between weft rows, and wherein the weft thread is interwoven with the second threads between weft rows.

4. The webbing of claim 3, wherein the second threads are interwoven with one another.

5. The webbing of claim 3, wherein an outermost portion of the weft thread is spaced a first distance from a longitudinal axis of the webbing and an outermost portion of the second threads is spaced a second distance from the longitudinal axis of the webbing, and the second distance is greater than the first distance.

6. The webbing of claim 1, wherein the protective portion is disposed within the main webbing portion and spaced from opposing side edges of the main webbing portion.

7. The webbing of claim 1, wherein the hard polymer coating does not penetrate between the second plurality of fibers.

8. The webbing of claim 7, wherein the protective portion is disposed within the main webbing portion and spaced from opposing side edges of the main webbing portion.

9. The webbing of claim 7, wherein the protective portion is disposed along an edge of the main webbing portion.

10. The webbing of claim 9, additionally comprising a weft thread interwoven with the first threads so as to extend laterally relative to the first threads over a plurality of weft rows, the weft thread changing direction between weft rows, and wherein the weft thread is interwoven with the second threads between weft rows.

11. The webbing of claim 10, wherein the second threads are interwoven with one another.

12. The webbing of claim 10, wherein an outermost portion of the weft thread is spaced a first distance from a longitudinal axis of the webbing and an outermost portion of the second threads is spaced a second distance from the longitudinal axis of the webbing, and the second distance is greater than the first distance.

13. The webbing of claim 1, wherein each of the second threads has a circular cross-section along the length of the webbing and each of the first threads has a non-circular cross-section along at least a portion of the length of the webbing.

14. A webbing comprising:

a plurality of first thread, each first thread comprising a first plurality of fibers said first threads woven together along a length of the webbing to form a main webbing portion having a width and a first thickness; and a plurality of second threads, each of the second threads comprising a second plurality of fibers encased in a polymer coating, the plurality of second threads woven together along the length of the webbing and attached to the main webbing portion so as to form a protective portion having is second thickness;

wherein each of the first threads comprises a first count of fibers and each of the second threads comprises a second count of fibers, the first count being greater than the second count; and wherein the polymer coating does not penetrate between the second plurality of fibers; and wherein the second thickness is greater than the first thickness.

15. The webbing of claim 14, wherein the plurality of second threads extend upwardly from the upper surface of the main webbing portion and downwardly below the lower surface of the main webbing portion.

16. The webbing of claim 14, wherein for each second thread the second plurality of fibers is arranged with a circular cross-section having a diameter of about 0.020-0.030 in., and the diameter is about 4-7 times a thickness of the polymer coating.

17. The webbing of claim 16, wherein each of the second threads has a circular cross-section along the length of the webbing and each of the first threads has a non-circular cross-section along at least a portion of the length of the webbing.

18. A webbing comprising:

a plurality of first threads, each first thread comprising a first plurality of fibers, said first threads woven together along a length of the webbing to form a main webbing portion having a width and a first thickness; and a plurality of second threads, each of the second threads comprising a second plurality of fibers encased in a hard polymer coating, the plurality of second threads woven together along the length of the webbing and attached to the main webbing portion so as to form a protective portion having a second thickness;

wherein the second thickness is greater than the first thickness; and wherein the hard polymer coating has a Rockwell hardness between and including R95 and R125.

19. The webbing of claim 18, wherein the hard polymer coating is Polybutylene Terephthalate ("PBT").

20. The webbing of claim 19, wherein the first plurality of fibers and the second plurality of fibers comprise nylon fibers.

21. The webbing of claim 18, wherein for each second thread the second plurality of fibers is arranged with a circular cross-section having a diameter of about 0.020-0.030 in., and the diameter is about 4-7 times a thickness of the hard polymer coating.

* * * * *